United States Patent [19]

Simpson

[11] 4,372,014

[45] * Feb. 8, 1983

[54] CONSTRUCTION SYSTEM AND FASTENER THEREFORE

[75] Inventor: Harold G. Simpson, Oklahoma City, Okla.

[73] Assignee: Star Manufacturing Co., Oklahoma City, Okla.

[ * ] Notice: The portion of the term of this patent subsequent to Feb. 3, 1993, has been disclaimed.

[21] Appl. No.: 645,601

[22] Filed: Dec. 31, 1975

Related U.S. Application Data

[63] Continuation-in-part of Ser. No. 445,498, Feb. 25, 1974, Pat. No. 3,935,682.

[51] Int. Cl.[3] ..... A44B 19/14

[52] U.S. Cl. ..... 24/201 C; 52/105; 52/536; 52/591

[58] Field of Search ..... 52/536, 105, 591; 156/66; 24/201 C

[56] References Cited

U.S. PATENT DOCUMENTS 2,960,561 11/1960 Plummer ..... 24/201 C

*Primary Examiner*—John E. Murtagh

*Attorney, Agent, or Firm*—Hubbard, Thurman, Turner & Tucker

[57] ABSTRACT

A construction system is disclosed utilizing prefabricated panels which can be assembled in a contiguous, aligned relationship to form a construction section. In one form of the system, the individual panels may include a structural core with a flexible membrane covering, and include an edge portion adapted to engage the edge portion of the next adjacent panel to provide a substantially contiguous seal between panels. The edge portions are sealable by fasteners which may be in the form of interlocking male and female members proportioned so that when joined the male members of one fastener will wipe along the inside walls of the fastener to which it is being connected to clean dirt from these walls and push the dirt into one or more dirt cavities formed when the fasteners are joined. Multiple areas of intense contact are also provided between the mating members of the fasteners to provide an effective watertight seal.

Also, a distinctive indicator, such as a color stripe along one or more of the ribs of each of the fasteners, may be provided which is visible during installation of the system when adjacent interlocking fasteners have not been fully engaged, and substantially hidden when the fasteners are so engaged by the coacting flaps on the fasteners.

A complete system and apparatus used therein is also disclosed for manufacturing the fasteners and bonding them to the flexible membrane panels in accordance with the invention.

16 Claims, 26 Drawing Figures

CONSTRUCTION SYSTEM AND FASTENER THEREFORE

CROSS REFERENCE TO RELATED APPLICATION

This is a continuation-in-part of U.S. patent application Ser. No. 445,498, entitled "Construction System Including Self-Cleaning Fasteners" and filed Feb. 25, 1974, now U.S. Pat. No. 3,935,682, issued Feb. 3,1976.

BACKGROUND OF THE INVENTION

1. Field of the Invention

This invention relates to a construction system utilizing prefabricated panels adapted to form a roof, wall, flashing, accessory, tank, container, pool, pond liner, or other construction sections, and in one of its aspects to interlocking, self-cleaning fasteners for use in providing a substantially continuous seal between the panels.

2. Description of the Prior Art

The construction of roofs, walls and other elements by conventional methods is a laborious process usually requiring on-site fabrication and erection of a suitable support structure. In an attempt to improve on conventional construction methods, it has been suggested to utilize panels which are prefabricated at the factory and are secured together at the job site. Copending patent applications Ser. No. 336,370, entitled "Roof Construction," now U.S. Pat. No. 3,909,998 and Ser. No. 336,364, entitled "Construction System," both filed on Feb. 27, 1973, and assigned to the assignee of this invention, illustrate highly satisfactory apparatus and methods for providing such improvements.

In patent application Ser. No. 336,364, a composite panel is disclosed as having a structural core which may be conventional laminated foam, cellular honeycomb or concrete, as well as other construction materials. An exterior sheeting or membrane of weathertight material such as a plastic or light gauge metal is secured to the outer surface of the panel. The membrane is formed with a flap along one or several edges which is adapted to overlie a marginal portion of an adjacent panel. The membrane flap is adapted to sealingly engage the marginal portion of the next adjacent panel. In the preferred form of the invention disclosed in that application, the flap and marginal membrane portions are sealable by virtue of male and female interlocking fasteners carried on the respective membrane portions. The interlocking fastener structure may take various forms and may include an expandable section to accommodate field assembly.

In patent application Ser. No. 336,370, now U.S. Pat. No. 3,909,998, a prefabrication panel is disclosed which is ideally suited for roof construction. The panel utilizes a corrugated metal member as a structural core, and an exterior, weather resistant sheet material is pre-adhered to the panel exterior. The sheet material is formed with a flap along one or several edges which is adapted to overlie a marginal portion of an adjacent panel. A seal is effected between overlapping membrane members by vulcanization or by virtue of interlocking fasteners carried on the flap and the marginal portions of the next adjacent panel.

In any such system as described with respect to the referenced co-pending patent applications, the fasteners employed for connection to the panels in the field must be easily and quickly operated, and must provide an effective continuous seal such as against weather. However, in the fasteners employed in such systems male and female coupling members of different configurations are generally provided, and it is not uncommon for dirt to get into and along the inside of the coupling members of the fastener, particularly during field use. When such occurs, because of the relatively close fit of the coupling members of the fasteners, dirt is pushed and packed inside the fastener during joining of two fasteners until, in some cases, it is difficult to fully close the fasteners and a leak may occur between them.

SUMMARY OF THE INVENTION

In the construction system of the present invention, which is of the same general type as disclosed in the aforementioned co-pending patent applications, this problem is effectively eliminated or substantially reduced by providing a plurality of construction panels, each of which includes a core member, and an exterior sheeting or membrane member formed with a novel fastener disposed along each adjacent edge of the membrane member of adjacent panels for interlocking engagement therebetween. Each such fastener includes means for wiping along the inside walls of another fastener to be connected therewith to wipe away dirt accumulated thereon, and at least one dirt cavity is provided in the fastener for receiving the dirt as it is pushed from the inside walls of the fastener. The respective fasteners that are coupled together include male and female interlocking members and the dirt cavity is formed by making the female portion deeper than the extent of penetration of the male member. As the fasteners are joined, the male member of each fastener wipes down across the inside surface of the mating female members of the other fastener and dislodges dirt or dust on these surfaces to allow a good seal between the fasteners. If this dirt were not removed by this wiping process, it would form a permeable barrier and act as a channel to allow water, air, or other fluid to penetrate the fasteners by flowing through the channel.

In the form of fastener illustrated herein, the fastener is an elongated zipper of flexible material that includes a body portion having male and female coupling means, such as projecting ribs and intermediate grooves for interlocking engagement with an identical zipper on an adjacent panel. The zippers include a connecting web extending from the zipper body which may be bonded to the edge of each membrane member so that the zippers along two opposite edges of the membrane member face inwardly towards the panel, and the zippers along the other two opposite edges of the membrane member extend outwardly from the panel. The zippers can be disposed along their respective membrane member edges so that they slightly extend beyond these edges a sufficient amount so that when adjacent panels are abutting each other adjacent zippers are overlapped for proper engagement. Also, if desired, the membrane members can be provided with opposite flap and marginal portions along their edges as described in patent application Ser. No. 336,364, with the fastener of this invention disposed along each of these portions. Further, the expansion/construction feature illustrated in that application may be utilized if the fasteners are not overlapped as described.

In designing fasteners of the type utilized in the present invention a difficult problem is to provide adequate sealing between the fasteners. This is particularly true where inclusion of some dirt which is not wiped away occurs, or a manufacturing defect occurs in a section of one of the fasteners.

In the process of manufacturing the fasteners of the present invention, it is more difficult to consistently get two large flat surfaces that mate continuously than it is to have one flat surface and one substantially knife-like edge surface mate continuously. This is especially true since the fasteners of the present invention are generally made of a somewhat flexible material that can deform slightly so that the total amount of pressure will be much more intense (force per unit area) if distributed across a substantially knife-like edge rather than if distributed across two more massive surfaces.

Thus, in order to ensure proper sealing, particularly in the instances noted, it is preferred that several areas of intensive contact be formed by substantially line contacts (analogous to a knife edge) between the surfaces of the contacting fasteners instead of extensive contact between flat surfaces. By creating a number of lines of relatively intense contact between the mating surfaces, water can be effectively prevented from passing these contact areas.

It is also desirable, as noted, that the zippers be formed of a material which is sufficiently deformable under pressure to flow into voids in the areas of intensive contact to further aid in providing a watertight seal.

Each of the intense contact areas should be complete, continuous and of enough intensity to prevent the pressure of the water from forcing the surfaces of adjoining fasteners apart and from passing between those two surfaces. Also, by using multiple points of intense contact, even if dirt is not wiped from one area, or a manufacturing defect prevents adequate sealing in one area, other areas of contact will provide sealing.

It is preferred that the fasteners of this invention (both the body and web portion) be made of an extruded flexible material, such as Hypalon (as hereinafter defined), which is normally of a thermoplastic state, and that the fastener be extruded in the configuration described. The flexible material should be adapted to respond to treatment whereby the body portion can be stiffened and permanently shaped to its extruded configuration by increasing its elastic modulus and permanent set without destroying the thermoplastic properties of the web portion.

This treatment to only the body portion of the fastener also permits it to withstand tension and compressive forces during usage which would otherwise cause it to fail, while permitting the web portion to be bonded to the flexible membrane of a panel, such as by a heat weld, as hereinafter described. In order to so stiffen and permanently shape the body portion of the fastener, without doing so the web portion, it is preferred that an irradiation process using Beta or equivalent rays be used as hereinafter described in detail for curing and cross-linking the body portion only. As also disclosed herein the extruded fastener material may be irradiated only to the depth of the body portion either while a length of fastener material is coiled together, such as to facilitate packaging and shipping, or while the fastener material is provided in continuous strips moving past a radiation source in a continuous process.

In field use of the fasteners described, where many feet of structural panels may be joined together in a day, even with easily installed fasteners it is not uncommon for a small section of the fastener to be left unfastened, or only partially joined, so that a leak can develop. Even when the installed system is visibly inspected, it is easy to miss seeing the unfastened or only partially joined section or sections since the system is generally a large surface area of the same color.

In the construction system of the present invention, this problem is effectively eliminated by providing fasteners such as described which include at least one indicator means providing a distinctive visual indication when the adjacent fasteners are not fully and properly engaged. Preferably, this means is a stripe having a color different from the color of the remainder of the fastener. The color stripe on each fastener is located along an edge thereof that is exposed except when the fastener is fully engaged with an adjacent fastener so that a person inspecting the system after installation can readily detect sections of the connected fasteners not fully closed. A kick flap may be provided on each fastener or on only one of the fasteners for deflecting forces that would tend to separate the fasteners, and to cover the color stripe when the fasteners are properly fastened. By use of the kick flap, the color stripe can be positioned on the fastener so that it can be easily seen from above the fastener when installed, but not fully connected.

With the use of zippers such as described, it is also possible that they can be improperly engaged by inserting a rib member in the wrong groove and this condition go unnoticed during visual inspection. Thus, in another embodiment of this invention, an elongated color stripe can also be provided along the length of that portion of any rib member that may be exposed when the ribs and grooves are improperly engaged as described. In this way, even if the color stripe along the edge of the fastener is covered, the second color stripe will be visible during inspection.

Thus, by use of the novel zipper design disclosed and claimed herein, a construction system is provided which can be erected and installed efficiently and economically with a good chance that the integrity of the seal provided by the system will be greatly increased because dirt accumulated on the fastener elements will not normally impede proper connection of the fasteners, and areas of intensive contact between the surfaces of joined fasteners will be maintained. Also by use of the visual indicator described there will be good chance that the seal provided by the fasteners will be ensured even with only a casual visual inspection or "walking over" of the system during or after installation.

BRIEF DESCRIPTION OF THE DRAWINGS

In the drawings, wherein like reference numerals are used throughout to designate like parts, and wherein preferred embodiments of this invention are illustrated.

DESCRIPTION OF THE PREFERRED EMBODIMENT

Figure 1:
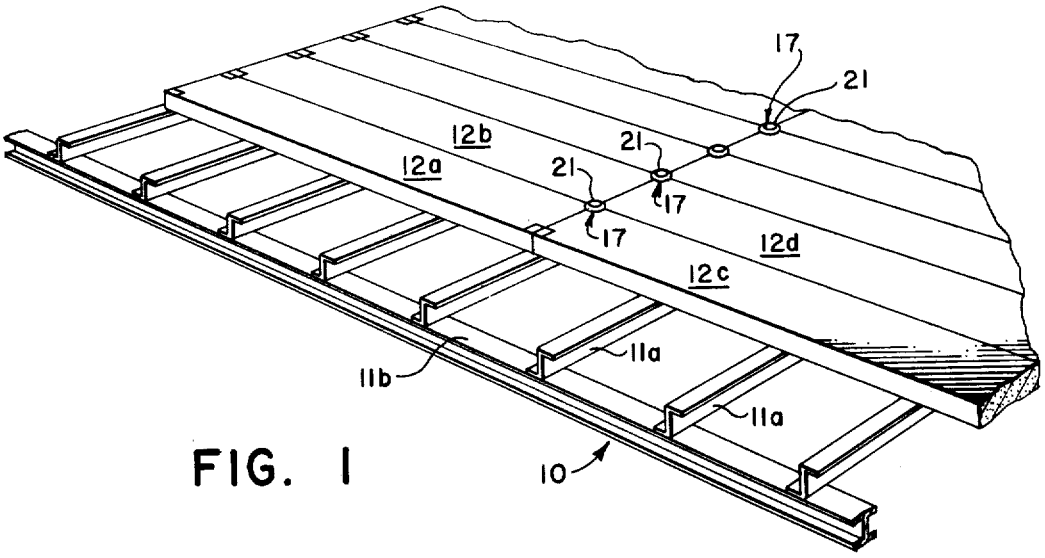
FIG. 1 is a perspective view showing a number of the panels of the present invention assembled to form a typical construction section, such as a roof.

Referring now to the drawings, FIG. 1 shows a construction assembly generally designated by the numeral 10 supported on an underlying series of parallel Z-shaped purlins 11*a* supported on a plurality of parallel beams or rafters 11*b*. Beams 11*b* are, in turn, supported on columns or bearing walls (not shown) as known in the art. For purposes of illustration, construction assembly 10 is shown in a horizontal position as representative of a typical roof structure. However, it should be noted that the assembly could as well be an exterior building or tank wall.

Figure 2:
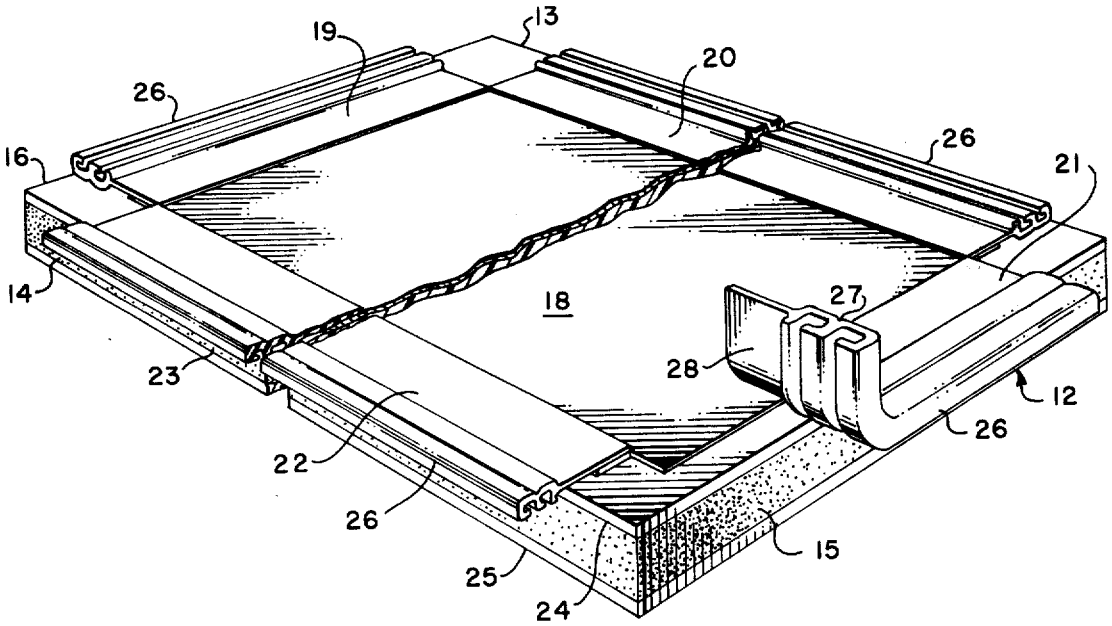
FIG. 2 is an enlarged perspective view of a single panel.

Construction assembly 10 includes a plurality of individual structural panels generally designated by the numeral 12 with the appended letters a, b, c and d used to denote separate panels of similar construction. The panels may, for example, be three feet wide by 20 to 30 feet long. In FIGS. 1 and 2, panel 12 is shown as being rectangular having opposite side edges 13 and 14 and opposite end edges 15 and 16. A number of similar panels 12 are contiguously aligned in a side-by-side and end-to-end arrangement to form assembly 10 with the individual panels abutting at common corner junctures 17. Panels 12 are covered with outer membrane sheet 18 of a weather resistant flexible material preadhered to the exterior surface, and membrane 18 includes edge portions 19, 20, 21 and 22 adapted to overlap with similar such edge portions of the next adjacent panel in a sealing relationship. The corner junction 17 of several panels may be sealed by a corner sealing structure 21*a*, such as the corner sealing structure illustrated in copending patent application Ser. No. 336,364, referenced above.

Referring to FIG. 2, the individual panel 12 may be formed having a structural core member 23 of a suitable material having good compressive, insulative, flexible and shear strength characteristics. For example, core 23 could be a polyurethane foam or a polystyrene. The upper surface of core member 23 is covered by sheathing member 24 and the lower or interior side of core member 23 is covered by sheathing member 25. Sheathing members 24 and 25 are typically a plastic or metal material suitably bonded or laminated to the opposite sides of core 23 which serve to give additional strength to the structure. Upper sheathing 24 also serves to provide a relatively hard, smooth underlay or surface beneath flexible membrane 18. Sheathing 25 may be provided with an appropriate decorative treatment when exposed within the building interior.

As noted, upper sheathing 24 is covered with membrane sheet 18 in the form of a weather resistant material to protect and seal the roof system 10. Membrane sheet 18 is substantially coextensive with the upper surface of the panel along its edges, except that its edge portions 19, 20, 21 and 22, including fasteners 26 as described in detail here, extend slightly beyond the edges 13, 14, 15 and 16 for overlapping relationship with similar such apparatus on an adjacent panel. For purposes of showing detail, fasteners 26 in FIG. 2 are slightly exaggerated in size in comparison with panel 12 since they are generally in the order of about ½ inch wide and ¼ inch high in the use illustrated. Membrane 18 is preferably a natural or synthetic rubber, or plastic, bonded or adhesively joined to the surface of upper sheathing member 24. Membrane 18, for example, may be a chlorosulfonated polyethelene material such as a material known under the tradename "Flex Seal" of B. F. Goodrich Tire & Rubber Co. or "Hypalon" a tradename of E. I. Dupont de Nemours Co., or a filled "Hypalon" material. Other material such as a flexible, light gauge aluminum or galvanized sheeting may be used as a material for the membrane.

Figure 3:
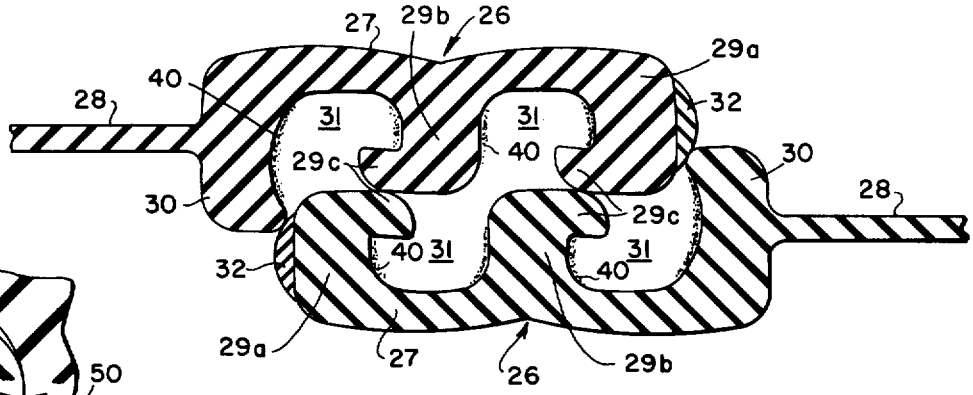
FIG. 3 is a sectional view of two fasteners of this invention just prior to joining.
Figure 4B:
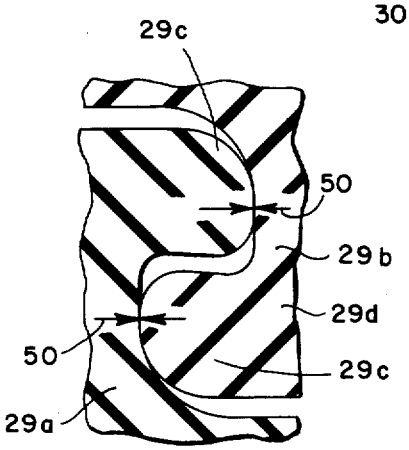
FIG. 4B is an enlarged view of a portion of FIG. 4A.
Figure 4A:
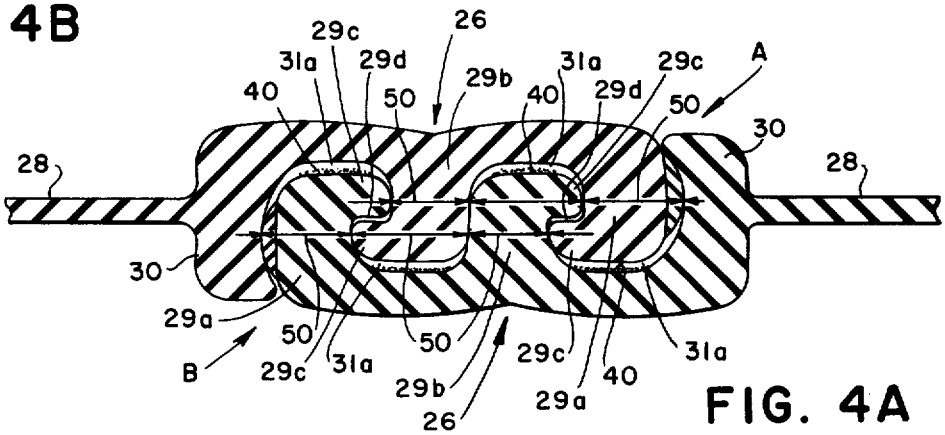
FIG. 4A is a sectional view similar to FIG. 3, but with the fasteners joined.
Figure 5:
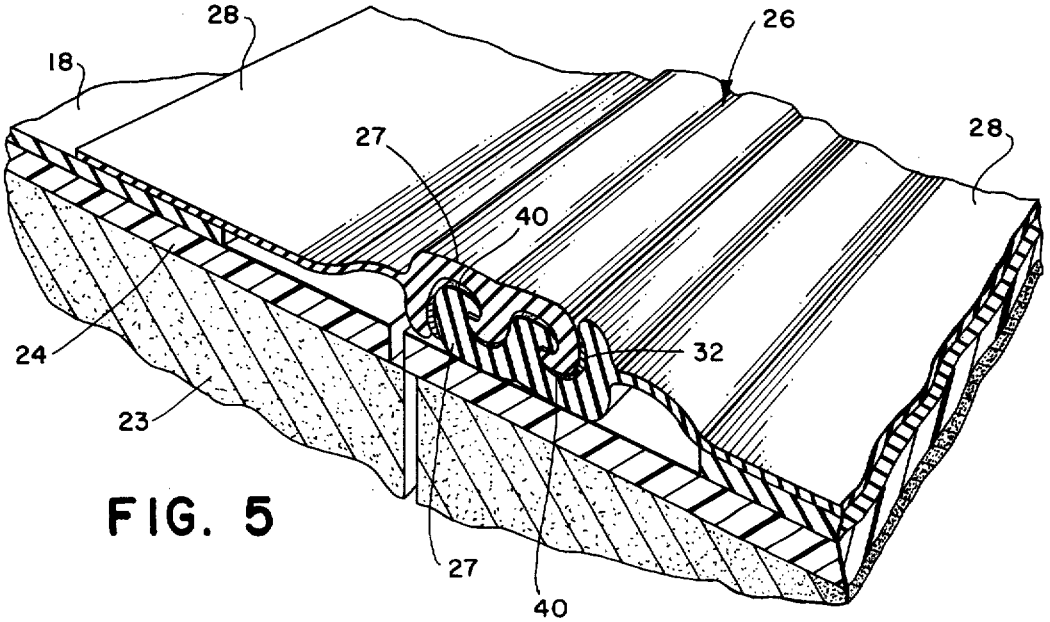
FIG. 5 is a perspective view showing adjoining fasteners of this invention connected to form a seal between adjacent panels.

Fasteners 26, which are shown in detail in FIGS. 3–5, are shown along either the longitudinal edges 20 and 22, or transverse edges 19 and 21 of membrane member 18. In either case, fasteners 26 may be identical except that along edges 21 and 22 they face downwardly from panel 12, and along edges 19 and 20, they face upwardly from panel 12. Also, along edges 19 and 20, fasteners 26 may extend only a small distance beyond edges 14 and 16 of panel 12, and fasteners 26 along edges 21 and 22 may extend beyond edges 13 and 15 of panel 12 a lesser amount as shown in FIG. 2, so long as the adjacent fasteners overlap each other so that they can be properly engaged when the adjacent panels carrying them are in substantial abutment.

Fasteners 26 include male and female coupling means, such as parallel, longitudinal ribs with grooves between them, as described below, and the ribs and grooves of fasteners 26 are adapted to interlock when force is applied, forcing the ribs into the grooves. The coacting sections are thus capable of being interlocked in zipper fashion to form a tight mechanical seal. Thus, fasteners 26 can easily be engaged by workmen as the panels are assembled to form a watertight seal. In some instances, an adhesive or vulcanizing agent can be applied between the coacting grooves and ribs at the time of securing the overlying membranes together to further ensure against penetration of moisture and seal the interior panel structure.

Various configurations of the male and female coupling means are suitable for the fastener arrangement. However, suitable configurations of fasteners 26 are shown as described with respect to FIGS. 3–8. In FIG. 3, two adjacent fasteners 26 are illustrated just prior to joining and in FIG. 4 they are shown in cross section as they would look when joined.

Referring now to FIGS. 3–5, fastener 26 is illustrated as an integral structure which may be separately manufactured and bonded to membrane member 18 during construction of panel 12. Fastener 26 includes an elongated body portion 27 and an elongated, flat web portion 28 extending from body portion 27 and adapted to be bonded to and along an edge of membrane member 18, or if desired, directly to the panel if made of suitable material. Fastener 26 may be made in elongated strips, and the strips may be cut to the appropriate length for mounting on the membrane member to form each of the respective edges of member 18. Body portion 27 of fastener 26 includes parallel ribs 29 and, in the embodiment illustrated, two such ribs are provided, with a kick flap 30, and two grooves 31 formed by and between ribs 29 and kick flap 30. As illustrated, the outer rib is designated *29a*, and the inner rib *29b*. Ribs *29a* and *29b* include inwardly projecting tooth portions or hook-shaped extensions *29c* for aiding in locking two such fasteners together when engaged. Body portion 27 therefore provides coupling means for interlocking engagement with similar coupling means on the adjacent fastener 26 on the adjacent panel 12.

Fastener 26 may be made of the same flexible material as membrane 18 and preferably should have at least the following characteristics:

(1) It can be formed, such as by extrusion, as an integral piece, including the body and web portion;

(2) The web portion should be adaptable to be easily and securely bonded to membrane 18 such as by the application of heat and pressure;

(3) The body portion should be adapted to be and permanently set and be sufficiently resilient to permit it to be distorted if required for insertion into a similar fastener and then returned to its original shape;

(4) It should have good weathering characteristics in all types of environments to permit it to be used in year-round outdoor service, and be adapted to be fireproofed;

(5) It should have good tensile and compressive strength to permit it to be walked over and subjected to high wind loads, and (6) It should be of a pleasing color or adapted to be made of such a color.

It has been found that the referred to "Hypalon" or "filled Hypalon" material meets all of these requirements and is preferred as the material for fastener 26.

As used in this application, the term "Hypalon" or "filled Hypalon" shall mean a material that includes as major ingredients, chlorosulfonated polyethylene, at least one stable polymer extender or filler, and various processing and milling aids if desired. Any inert filler material such as titanium-dioxide, carbon-black, ground clay, and the like can be utilized as the polymer extender. Various processing and milling aid materials that are compatible with the chlorosulfonated polyethylene material can be utilized in the instant compositions that are referred to as "Hypalon" and "filled Hypalon" throughout this specification. Normally, the chlorosulfonated polyethylene will be in an unvulcanized state.

As shown in FIGS. 3 and 4A, ribs *29a* and *29b* are of such lengths with respect to grooves 31 so that when the adjacent fasteners are engaged as in FIG. 4, a small dirt cavity *31a* is formed in each of grooves 31 between the end of the rib projecting into the groove and the inner end or bottom wall of the grooves. Also, it is preferred that a small clearance *29d* be left between inwardly projecting extension *29c* to accommodate dirt that may be on the adjacent edges of projecting extensions *29c*. Otherwise, the mating rib and groove elements are designed to have an interference or close-fit to seal between them, preferably along the areas indicated by the arrows 50 in FIG. 4A to establish substantially lines of intense contact as further described below. FIG. 4B and FIGS. 6–8 show this feature in more detail.

Thus, with the construction as illustrated, if dirt (shown generally as 40) accumulates on the inside walls of a fastener 26, as it is joined to another fastener 26, the ribs *29a* and *29b*, and particularly extensions *29c* of each fastener, and the outside surface of rib *29a*, will wipe along the adjacent inside wall of the other fastener to force the dirt down into cavities *31a*, and since the cavities are present, permit the fasteners to be engaged with little or no interference. The size and depth of the dirt cavities formed can vary as long as the structural integrity and sealing effectiveness of the fastener is not impaired. For this purpose, the thickness of the hook-shaped extension *29c* in the direction in which the rib member extends is substantially less than the depth of grooves 31 to permit cavity *31a* to be formed.

This relationship also allows ribs 29 to be inserted into grooves 31 without the outside of the ribs interfering with the inside grooves prior to complete insertion. This feature allows the fastener to be assembled without compressing either the rib or groove material prior to complete insertion and is an important feature because it is easier to build up the forces required for effective sealing at the side of the ribs through stretching the grooves than it is by direct compressive force at the end of the rib against the bottom of the groove.

With this arrangement the only forces that must be overcome in closing the fastener are the frictional force between the two more or less vertical surfaces where the ribs and grooves come into contact during the sliding insertion, and the force required to open the area about hook-shaped extensions *29c* of one fastener so that the hook-shaped extensions *29c* of the other fastener can be inserted in groove 31. These forces are relatively minor in comparison to the force required to compress the material in a fastener where the ribs compress the bottom of the grooves. Also, since in the arrangement illustrated in FIG. 4A bottoming compressive forces are not present to interfere with the sealing relationship between the sides of the ribs and grooves, the intense contact feature referred to and explained in detail below can be provided without interference caused by distortion of the groove material.

As previously noted, it is preferred that the sealing between the fasteners be provided by a plurality of intense, substantially line contacts in the area indicated by the arrows 50 to provide a series of dams that prevent leaking through the fastener. In this manner should one of these dams fail then one or more of the other dams provided will prevent the passage of water through the fastener. For example, in FIG. 4A, water passing from the area A to the area B must pass by a series of eight such dams represented by the head-to-head abutment of arrows 50.

Figure 6:
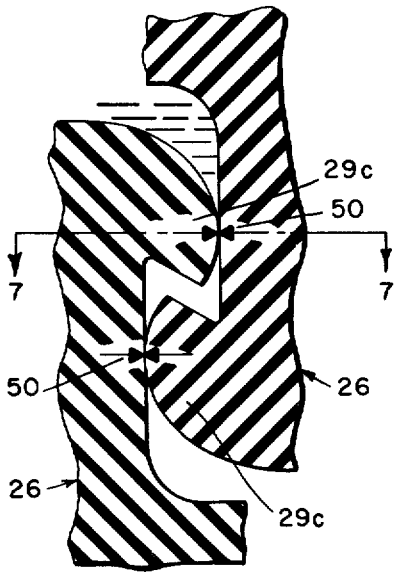
FIG. 6 is a partial sectional view through a configuration of fasteners of this invention emphasizing the intense contact feature.
Figure 7:
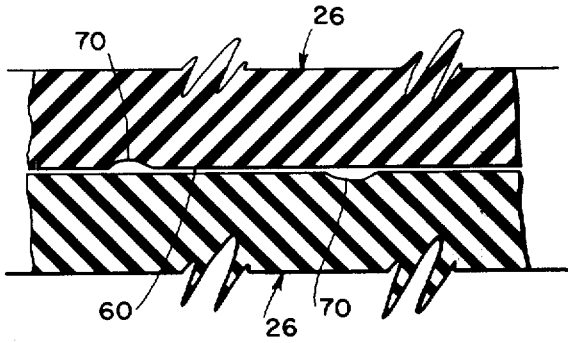
FIG. 7 is a sectional view taken at 7—7 in FIG. 6.
Figure 8:
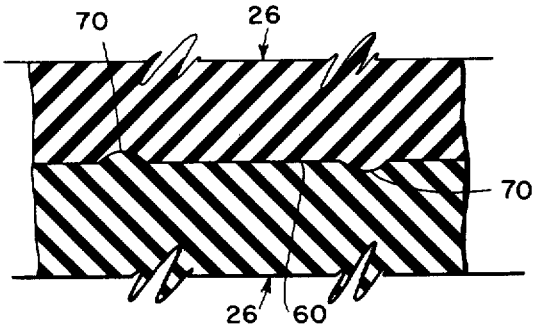
FIG. 8 is the same view as FIG. 7 illustrating the fastener material under pressure.

In FIG. 6 the construction of ribs 29 and hook-shaped extension 29*c* is such that the area of intense contact indicated by arrows 50 is enhanced. The reference numeral 60 represents this area which has the effect of substantially a line contact as shown in FIG. 7. In FIG. 7 it is assumed that there are irregularities 70 in the surface of each of the mating members along the length of area 60 in which the intense contact is to be provided. If the area 60 of the contact of the members is substantially along a line, instead of a large flat area, and the fasteners are made of a deformable material, the material in the areas 60 will flow together to fill voids 70 created by the surface irregularities when pressure is applied urging the mating surfaces together, as in FIG. 8. Also, with a substantial line contact the intensity of the mating force will be substantially greater and the sealing more effective than with the same force applied to a greater contact area. As noted, the provision of multiple dams by providing several areas of intense contact is advantageous in that if one of the dams fails because of a misfabrication in the fastener material, or because a dirt particle has been lodged at one of the intense pressure dams, the next dam will prevent the water from completely traversing across the full width of the zipper.

Thus, a construction system is provided by the present invention which provides for ready connection and sealing of adjacent panels of the system even where one or more of the coacting fasteners may have dirt accumulated inside of it prior to installation, along with an adequate and continuous weatherproof seal. With the present invention, the amount of dirt inside the fastener that can be wiped into the dirt cavities to permit proper fastening may be sufficient so that many field installations are made possible where they would otherwise not be possible, and multiple areas of intense contact can be provided to insure the seal provided by the fasteners.

Another important feature of this invention is that a colored stripe, such as provided by a strip 32 of the material having a color different from the rest of fastener 26, may be provided along the outer edges of each of fasteners 26 as described below. In this case, the outer edge of strip 32 of one fastener will wipe along the adjacent inside surface of the grooves 31 of the other fastener into which it fits.

Figure 9:
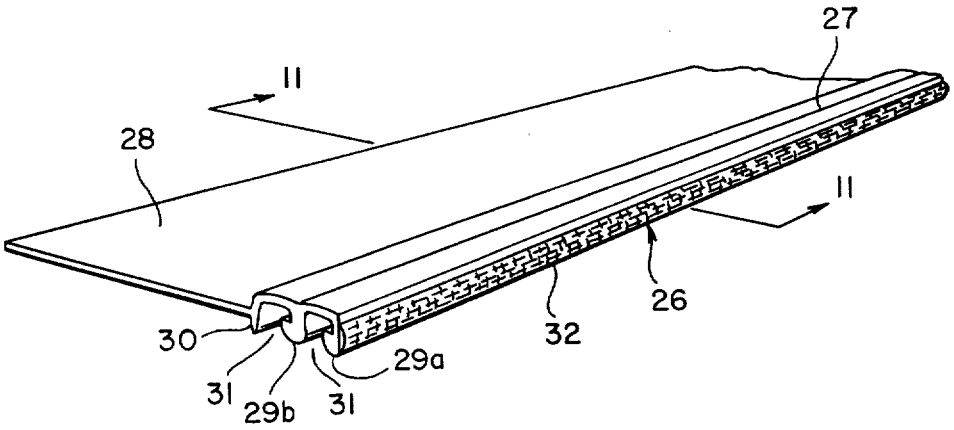
FIG. 9 is a perspective view of one embodiment of the fastener of this invention employing the color stripe.
Figure 10:
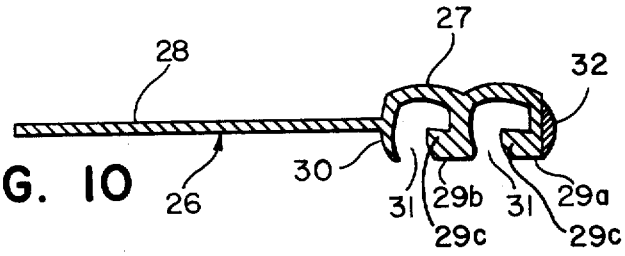
FIG. 10 is a sectional view taken at 11—11 in FIG. 9.
Figure 11:
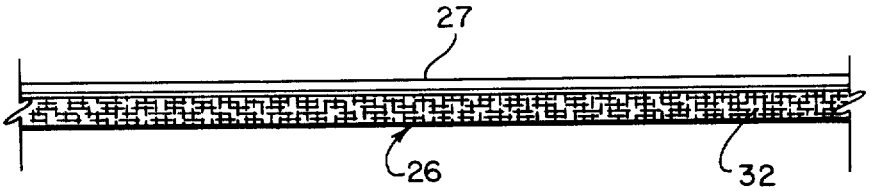
FIG. 11 is a side view of the FIG. 10 fastener.
Figure 19:
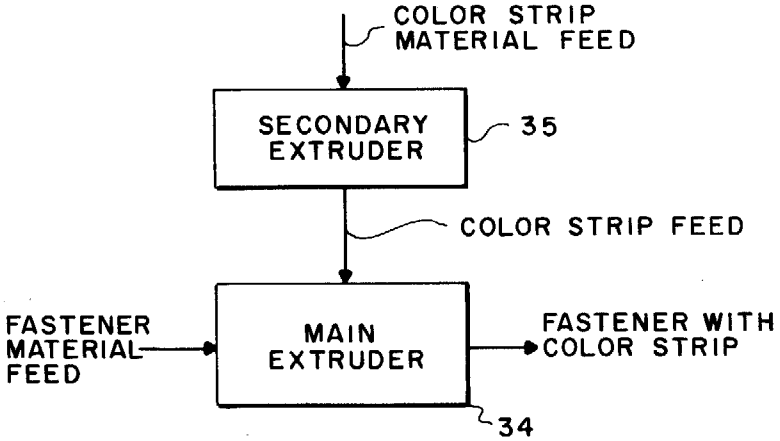
FIG. 19 is a diagrammatic view of one form of the process of extruding the fastener of this invention.

Referring now to FIGS. 9-16, various forms of fastener 26 are illustrated as employing color stripes, which function as an indicator means for providing a distinctive indication when adjacent fasteners on adjacent panels are not at least substantially fully engaged or interlocked, during or after installation. This means is such that by visual inspection of the construction system during or after installation, it can be readily determined whether or not the respective fasteners are fully engaged, which is necessary to provide and maintain the required moisture seal. As illustrated in the embodiment of FIGS. 9-11, this means preferably includes a color stripe such as provided by an elongated color strip 32 integral with or bonded along the entire length of the outer edge of rib 29*a*. For example, sections 27 and 28 of fastener 26 may be beige or white in color, and color strip 32 may be yellow or red, or some other color which is distinctive of the color of the remaining parts of the fastener. As illustrated in FIG. 19, during the manufacture of fastener 26, as the fastener is extruded through a main die extruded 34, a color stripe material, which may be a material different from the remainder of fastener 26, for example, pigmented polyethylene, may be fed from a secondary extruder 35 on stream into extruder 34 so that the color strip material displaces fastener material along the outer edge of rib 29*a*. The amount of material so displaced can be controlled by controlling the pressure of the color strip feed, as the color strip and fastener are co-extruded.

Of course, the color stripe can be provided by a different color along the length of the outer edge of rib 29*a* without the use of the separate color strip material.

Figure 12:
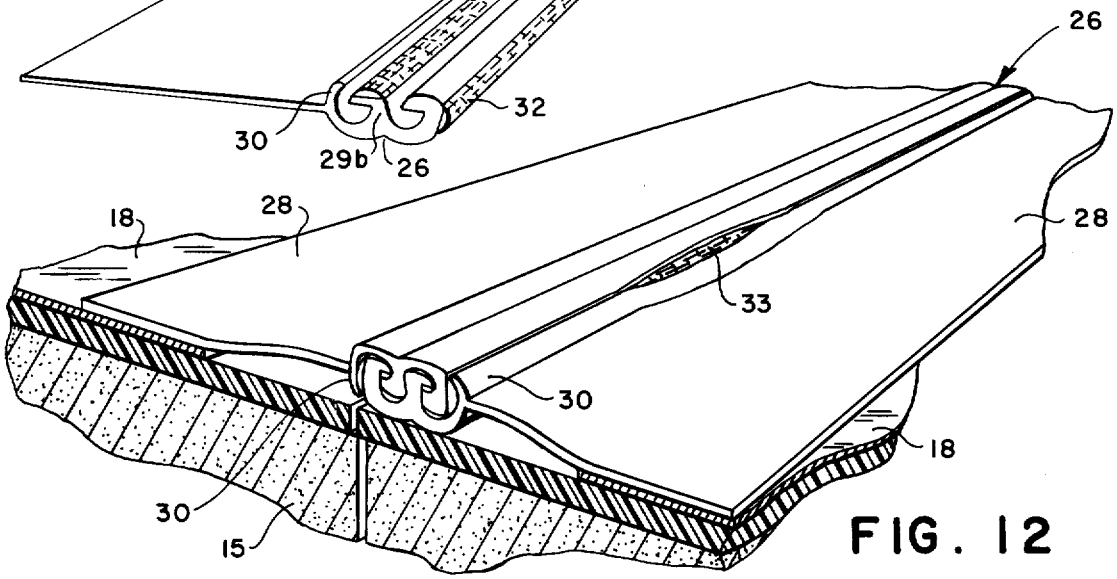
FIG. 12 is a perspective view showing adjoining fasteners of this invention with a section thereof not fully joined.
Figure 13:
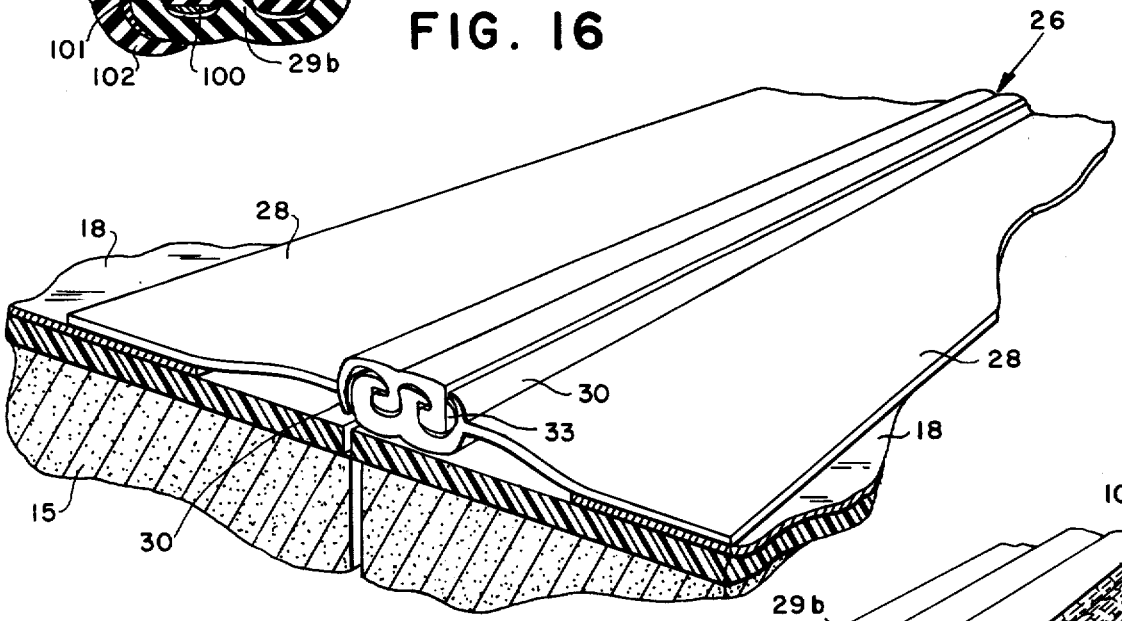
FIG. 13 is the same view as FIG. 14 but with the fasteners fully joined.
Figure 15:
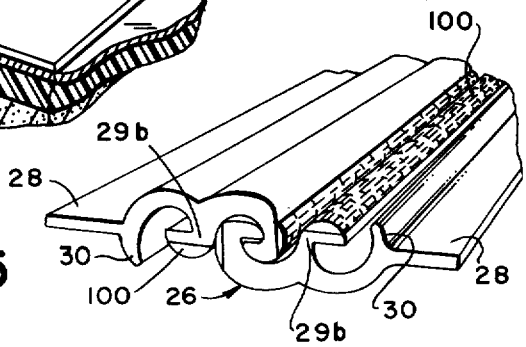
FIG. 15 is a view illustrating of the manner in which the additional color stripe of FIG. 14 indicates improper connection of the fasteners.

Referring now to FIGS. 12 and 13, illustration is provided of the manner in which color strip 32 provides the distinctive indication or improper or incomplete connection between adjacent fasteners 26. As illustrated in FIG. 12 wherein a portion along the length of the connection between adjacent fasteners 26 is illustrated as only partially closed, color strip 32 would clearly be visible to a person inspecting the system and steps can be readily taken to complete the closure. FIG. 15 illustrates the manner in which adjacent fasteners 26 appear when properly and completely installed. As shown in FIG. 15, kick flap 30 of each of the fasteners extends over color strip 32 to substantially or completely cover it up. By use of such a kick flap, which also function to deflect forces that would otherwise tend to cause the fasteners to separate, and to add further protection against weather, color strip 32 can be positioned along the outer edge of rib 29*a* so that it is exposed from above panel 12, and can be readily seen by a person looking at the panel, when kick flap 30 does not properly cover color strip 32, indicating in turn that fastener 26 is not properly interlocked.

Figure 14:
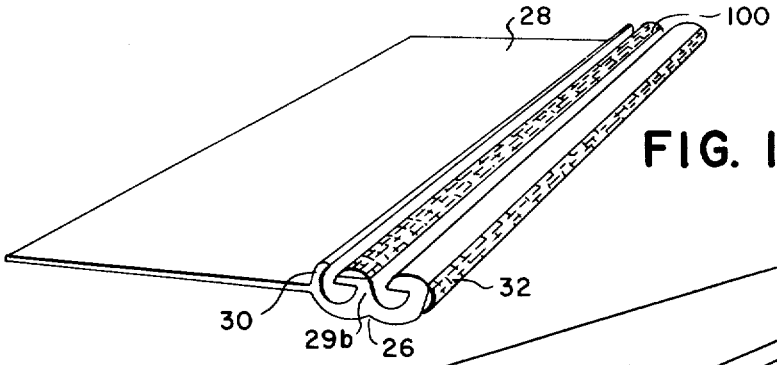
FIG. 14 is a view in elevation of another embodiment of the fastener of this invention which includes a color stripe along an intermediate rib thereof.

Referring now to FIGS. 14 and 15, another embodiment of the fastener of this invention is illustrated in which a color stripe 100 is provided along the edge of intermediate rib 29*b*. As illustrated in FIG. 15, it is possible during engagement of fasteners 26 to inadvertently place rib 29*a* into the groove 31 furtherest from web 28. Since to do so would at least partially, if not completely, cover color stripe 32, the provision of color stripe 100 insures that a person making a visual inspection of a construction system of this invention would be alerted to the condition of FIG. 15. FIG. 13 illustrates the correct relationship of the fasteners 26 in which both color stripes 32 and 100, if it were provided along rib 29*b* (color stripe 100 not being shown in FIG. 13), of each fastener would be covered by the other fastener.

Figure 16:
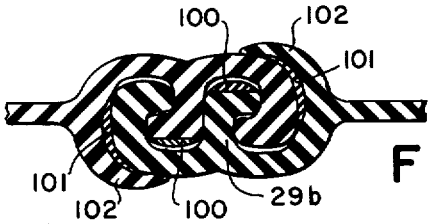
FIG. 16 is a sectional view in elevation of another embodiment of the fastener of this invention which includes a color stripe.

FIG. 16 illustrates another form of the present invention wherein each of fasteners 26 includes a color strip such as provided by color stripes 101 and kick flaps 102 which extend up and over the outer ribs of the fasteners to permit visual inspection through a wider angle than is possible with the embodiment of FIG. 9.

Thus, a construction system is also provided by the present invention which provides for ready connection and sealing of adjacent panels of the system and permits visual inspection of the system during or after installation to determine whether or not the seal between adjacent panels has been fully completed. Because of the distinctive color of the color stripe, visual inspection can be readily made and the chances that sections of the fastener not completely installed will be missed during such an inspection are greatly reduced.

Also, while the fastener of this invention is illustrated as part of a roof assembly, it can, of course, be utilized with other types of assemblies, including adjacent sections connected together to provide a continuous seal between the sections.

Figure 17:
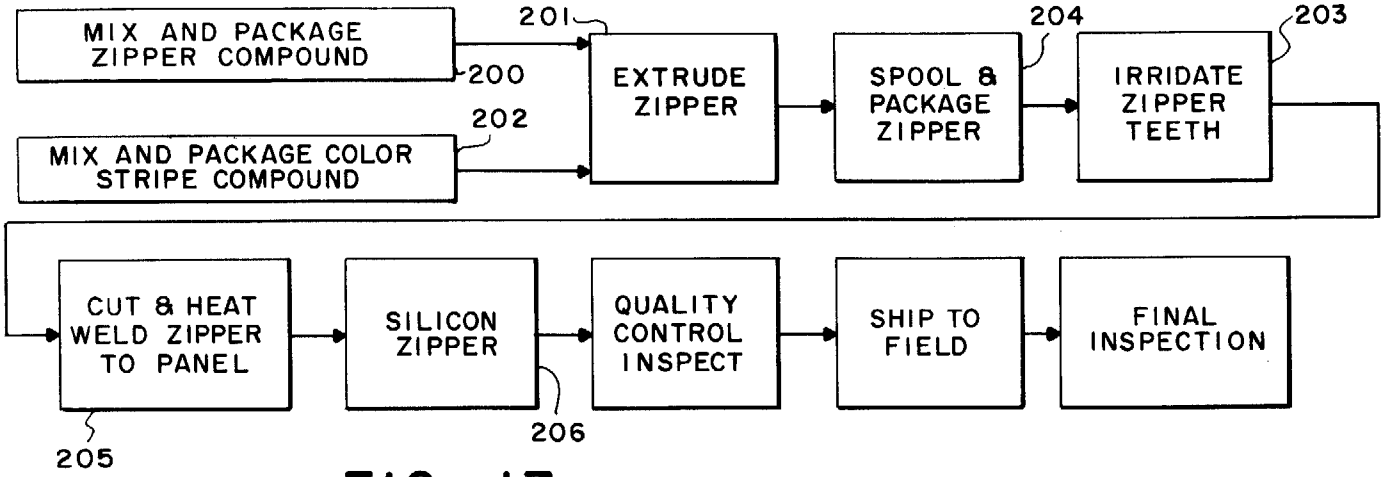
FIG. 17 is a flow diagram of one form of the manufacturing process of the fasteners of this invention.
Figure 18:
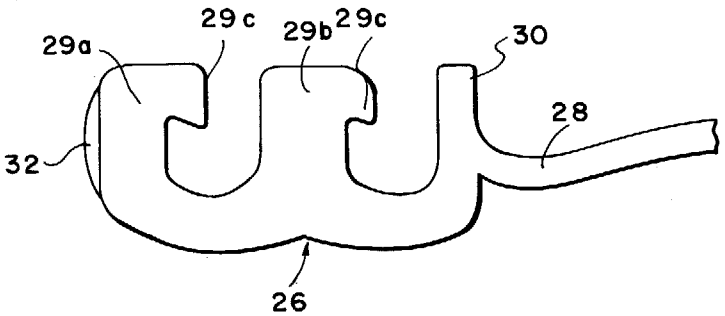
FIG. 18 is an end view in elevation of a fastener of this invention.

Referring now to FIG. 17, a complete process of manufacturing a fastener such as shown in FIG. 18 is illustrated, as are the steps involved in coupling the fastener shown to a construction panel and the steps involved in field installation of the panels. FIGS. 19 to 24 illustrate in more detail some of the steps of the manufacturing process.

In the process of manufacture of the fastener of FIG. 18, the fastener compound is combined and mixed as represented by box 200 and the color stripe compound is combined and mixed as represented by box 201. The reference to packaging in boxes 200 and 201 is for the case where the material is formulated at one location and extruded elsewhere.

Box 203 represents the step of extruding the fastener including the body portion and web portion and is illustrated in detail in FIG. 19 as previously described. It is preferred that the extrusion die have a configuration so that the fastener 26 of FIG. 18 is provided including a body portion 27, web portion 28, ribs 29*a* and 29*b* each having a tooth 29*c*, kick flap 30, grooves 31, and a color stripe 32. However, as extruded, particularly if the fastener is "Hypalon" or a "filled Hypalon" material, the fastener material (both body portion 27 and web 28) is generally relatively soft and pliable and it is also preferred that a step be provided in the manufacturing process wherein only the body portion of the fastener is stiffened and permanently set, and its modulus of elasticity increased, without changing substantially the properties of the web portion.

Figure 20:
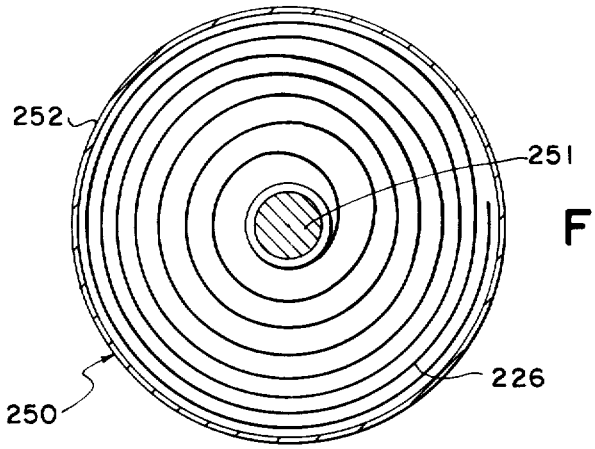
FIG. 20 is a top view in elevation of a length of fastener material coiled together for packaging and for irradiation.
Figure 21:
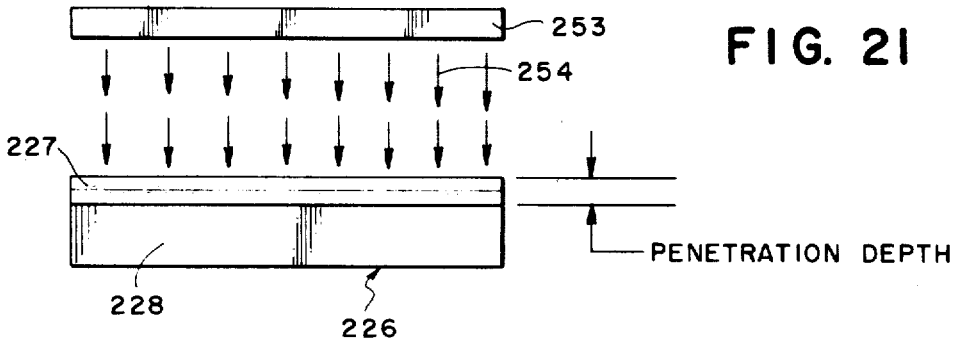
FIG. 21 is a side view in elevation showing the irradiation process when the fastener material is handled in the coiled form of FIG. 20.

For this purpose, it is preferred that the body portion of the fastener, but not the web, be irradiated with Beta or similar rays as illustrated by box 203 in FIG. 17 and as shown in detail in FIGS. 21, 22*a*, 22*b* and 22*c*. In the case where the extrusion of the fastener and the irradiation steps occur at two different locations, it is preferred that a length of extruded fastener material be spooled in spools of a predetermined radius (box 204 in FIG. 17 and FIG. 20) to facilitate packaging and shipment as well as irradiation as shown in FIG. 21. As shown in FIGS. 20 and 21, by so spooling the fastener material onto a spool 250, including a center core member 251 and an outer protective shell or flange 252, the spool can be placed flat in a box (not shown) for shipment and then taken from the box and placed flat under an irridiation source 253, with the body portion being under or adjacent the irradiation source, for the irradiation step, so that Beta rays 254 will penetrate only body portion 27 of fastener 26 and will not penetrate into web 28. For this purpose, although conditions may vary and cause adjustments in the required dosage, it has been found that irradiation dose of about 10 megarads, provided by a Beta electron beam of about 1.23 MEV in a single irradiation pass has been adequate to provide the desired change in the properties of the fastener resulting in increase in the elastic modulus and permanent set of the body portion of the fastener. By utilizing this step the desired durability and strength characteristics of the fastener previously discussed are also provided.

Figure 22A:
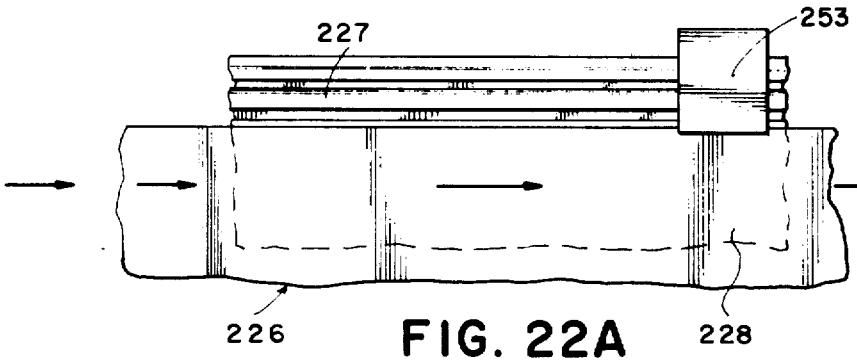
FIG. 22A is a top view in elevation showing the continuous irradiation with the fastener material in a continuous moving strip.
Figure 22B:
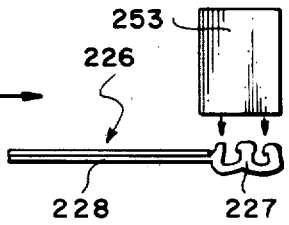
FIG. 22B is an end view of the apparatus of FIG. 22A.

In spooling a length of fastener material for the irradiation step described, a convenient size for the spool may be from two to four feet in diameter. Also, in order to insure substantially uniform physical properties of the body portion of the fastener after irradiation the fastener material should be spooled in such a way that the top edge of the body portion when oriented as shown in FIG. 21 is flat within $\pm 1/16$ inch when viewed from the axis of the spool.

Where the fasteners are extruded and irradiated at the same location, it may be desirable to provide a continuous process of irradiating a length of fastener material 26 as it is moved longitudinally along a path beneath a stationary source of irradiation 253. For this purpose means such as a conveyor belt 255 may be employed to move the fastener material beneath the irradiation source 253, and a shield plate 256 may be provided to shield rays 254 from web portion 228 of the fastener. The body portion of the fastener is adjacent the irradiation source and the irradiation rays are controlled so that the rays pass substantially only through the body portion of the fastener, as shown in FIG. 22A.

Figure 23:
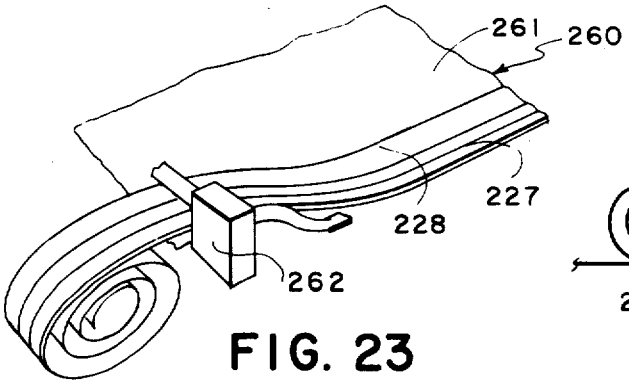
FIG. 23 is a perspective view in elevation showing the process of heat welding the fastener material to a fabricated roof or wall panel.
Figure 24:
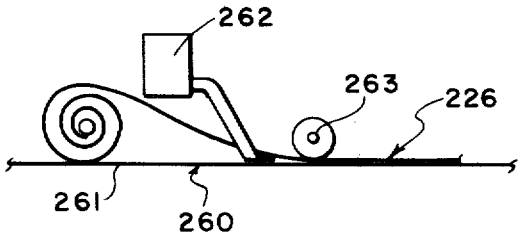
FIG. 24 is a side view of the apparatus of FIG. 23.

Referring now to FIGS. 23 and 24, the steps involved in heat welding the irradiated length of fastener material to a construction panel, which steps are represented by box 205 in FIG. 17, are illustrated. As shown in FIG. 23, a length of fastener material 26, is cut to the length of a panel 260 including a flexible membrane member 261 of "Hypalon" or similar material. As the length of fastener material is layed along the edge of membrane member 261, heat is applied such as by a heat gun 262 to both the outside surface of membrane member 261 and the lower surface of web 228 to cause the members to heat weld together. In addition, pressure is also preferably applied such as by a roller 263 to aid in the described process, and if necessary, solvent can be added to chemically bond the surfaces together, particularly where the heat is applied such as by a heat gun 262 to both the outside surface of membrane member 261 and the lower surface of web 228 to cause the members to heat weld together. In addition, pressure is also preferably applied such as by a roller 263 to aid in the described process, and if necessary, solvent can be added to chemically bond the surfaces together, particularly where the irradiation rays may have penetrated part of the web. The heat welding process is repeated for each edge of panel 260 so that a panel with fasteners along each edge such as shown in FIG. 2 is provided.

Upon completion of the heat welding process, it is preferred that a lubricant, such as silicone be applied or coated on the ribs of fastener 26 to aid in coupling the fasteners to a similar such fastener in the field. This step is represented by box 206 in FIG. 17. It is preferred that the lubricant be added to the fastener after the fastener has been heat welded to the membrane 18, since the addition of silicone directly to the fastener impairs the weldability of the web of the fastener to membrane 18 because minute parts of the silicone may be inadvertantly transferred to the web causing immediate welding problems or, in some instances, later delamination of the two materials being welded together .

As should be evident from the above description of the various embodiments and features of this invention, the fasteners described, and the process described for manufacturing and utilizing them may take a number of different forms. For example, while the color stripe is conveniently co-extruded with the fastener material as described, since it generally serves no further function once the fasteners have been installed in the field, the color stripe could be painted on the outside surface of the fasteners. Also, it may be desirable to add a component to the fastener compound (or to coat the fastener) to effectively render it fireproof, particularly where it is used with roof panels.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

While many possible embodiments may be made of the invention without departing from the scope thereof, it is to be understood that all matter herein set forth or shown in the accompanying drawings is to be interpreted as illustrative and not in a limiting sense.

What is claimed is:

1. A fastener adapted to be disposed along an edge of a member in a construction system including a plurality of such members arranged side by side, said fastener comprising, in combination:

a fastener body including coupling means for cooperative fastening relationship with a fastener along an adjacent member;

means for providing connection between said fastener body and the member on which it is to be disposed; and indicator means located on said body for providing a distinctive indication when said coupling means is not at least substantially fully engaged with the adjacent fastener.

2. The fastener of claim 1 wherein said indicator means includes at least one color stripe having a color distinctive of the color of said body.

3. The fastener of claim 2 wherein said color stripe is provided by an elongated strip of material along an outer edge of said fastener.

4. The fastener of claim 3 including a second color stripe provided by an elongated strip of material along an intermediate edge of said fastener.

5. The fastener of claim 1 wherein said coupling means comprises male and female members.

6. The fastener of claim 2 wherein said coupling means is elongated and comprises alternate male and female members.

7. The fastener of claim 4 wherein said elongated strip member is disposed along an outside edge of said body and is adapted to be substantially covered by the adjacent fastener when properly engaged therewith.

8. The fastener of claim 1 wherein the cooperative fastening relationship between adjacent fasteners provides a substantially weathertight seal.

9. The fastener of claim 1 further including a kick flap on said fastener body adapted to lap over a portion of the body of said fasteners along an adjacent structural panel.

10. A fastener made of a elastomeric material and adapted to interlock with another similar fastener to provide a seal between the fasteners, said fastener including a body portion including at least one male and female member for interlocking engagement with similar such members of said members of said similar fastener and a web portion extending from the body portion for connecting said fastener to another member, said fastener being made by a process including the steps of:

manufacturing a quantity of fastener material from a elastomeric material into the configuration including said body portion and said web portion; and operating on the manufactured fastener to cause cross-linking of substantially only said body portion.

11. The fastener of claim 10 further including indicator means located on said body for providing a distinctive indication when said coupling means is not at least substantially fully engaged with said similar fastener.

12. The fastener of claim 10 wherein said fastener is made of a material comprising a substantial portion of a cholosulfonated polyethelene material.

13. The fastener of claim 10 wherein said fastener body is of a configuration with respect to said similar such fastener to provide at least one line of intensive contact to provide sealing between the fasteners.

14. The fastener of claim 10 wherein the male and female members of said fastener body are proportioned with respect to mating members of said similar such fastener so that at least one cavity is provided for the collection dirt between the walls of the mated portion of said fastener bodies when mated together.

15. The fastener of claim 10 wherein said manufacturing step includes extruding said elastomeric material.

16. The fastener of claim 10 wherein said cross-linking is provided by the steps of moving the manufactured fastener into an irradiation zone, and then irradiating only substantially said body portion of the fastener with a plurality of rays.

* * * * *